US008920051B2

(12) United States Patent
Shishido et al.

(10) Patent No.: US 8,920,051 B2
(45) Date of Patent: Dec. 30, 2014

(54) PRINTING METHOD AND PRINTING APPARATUS FOR PRINTING A PLURALITY OF IMAGES ON A SHEET USING A PRINT HEAD

(75) Inventors: Kazunari Shishido, Yokohama (JP); Sho Nakamura, Yokohama (JP); Ruriko Mikami, Kawasaki (JP); Atsushi Hirahara, Kawasaki (JP); Takayoshi Noguchi, Tokyo (JP); Akiteru Naka, Machida (JP); Tatsuhiko Tomita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 163 days.

(21) Appl. No.: 13/365,141

(22) Filed: Feb. 2, 2012

(65) Prior Publication Data

US 2012/0199022 A1 Aug. 9, 2012

(30) Foreign Application Priority Data

Feb. 8, 2011 (JP) ..... 2011-025253

(51) Int. Cl.

| | |
|---|---|
| ***B41J 11/44*** | (2006.01) |
| ***B41J 29/393*** | (2006.01) |
| ***B41J 11/70*** | (2006.01) |
| ***B41J 29/46*** | (2006.01) |
| ***B41J 15/04*** | (2006.01) |
| ***B65H 43/00*** | (2006.01) |
| ***B41J 29/38*** | (2006.01) |

(52) U.S. Cl.

CPC *B41J 11/70* (2013.01); *B41J 29/46* (2013.01); *B41J 15/04* (2013.01); *B65H 43/00* (2013.01); *B41J 29/38* (2013.01)

USPC ..... 400/76; 400/611; 347/19

(58) Field of Classification Search

None

See application file for complete search history.

(56) References Cited

U.S. PATENT DOCUMENTS

| | | | | |
|---|---|---|---|---|
| 6,575,546 | B2 * | 6/2003 | Matsumoto et al. | 347/14 |
| 8,408,827 | B2 * | 4/2013 | Takeuchi et al. | 400/76 |
| 2011/0279508 | A1 * | 11/2011 | Naito | 347/16 |

FOREIGN PATENT DOCUMENTS

| | | | |
|---|---|---|---|
| JP | 2001-239715 | A | 9/2001 |

* cited by examiner

*Primary Examiner* — Ren Yan
*Assistant Examiner* — Justin Olamit
(74) *Attorney, Agent, or Firm* — Canon USA, Inc., IP Division

(57) ABSTRACT

A state of a print head is checked by printing a plurality of images in order on a sheet fed from a sheet feeding unit, and reading the printed images. A region that is inappropriate for performing printing on the fed sheet is detected. When the inappropriate region has been detected, printing the images is stopped and the sheet is cut. Of the cut sheets, the sheet at an upstream is sent back to the sheet feeding unit. Subsequently, the sheet is again fed to perform printing and conduct a test.

5 Claims, 5 Drawing Sheets

PRINTING METHOD AND PRINTING APPARATUS FOR PRINTING A PLURALITY OF IMAGES ON A SHEET USING A PRINT HEAD

BACKGROUND OF THE INVENTION

1. Field of the Invention

The present invention relates to a technique for printing a plurality of images on a sheet using a print head.

2. Description of the Related Art

A continuous sheet in a roll shape is used for printing a great amount of sheets in a printing shop, for example. When producing the continuous sheet in a roll shape, to increase a yield ratio of production, end portions of a plurality of continuous sheets having a shorter length than a necessary length are connected with each other with fixing material (hereinafter, referred to as a "tape") to give a roll a necessary length. The continuous sheet in a roll shape includes at random positions one or more splices (joint portions) connected with the tape.

An apparatus discussed in Japanese Patent Application Laid-Open No. 2001-239715 detects a position of the splice by detecting the tape using an optical sensor, sets a region including the splice as a non-printing region, and performs control not to carry out printing therein.

A printing apparatus performing a great amount of printing needs maintenance on a periodic basis. Thus, in addition to a normal print mode, a maintenance mode is preferably provided. The maintenance mode prints a test image including a specific pattern different from a normal image on a sheet, and checks a print state by reading the pattern with a scanner and analyzing it.

The splice is a region (referred to as an "inappropriate region" in this specification) that is inappropriate for printing the image. When the test image is printed on the sheet, if the test image is formed on the splice, a defect pattern is read, which prevents correctly carrying out an apparatus check. The apparatus discussed in Japanese Patent Application Laid-Open No. 2001-239715 does not give any consideration to printing and checking of the test image.

SUMMARY OF THE INVENTION

The present invention is directed to a method for correctly conducting a test without sustaining impacts of an inappropriate region, even when using a sheet including the inappropriate region that is inappropriate for printing when the test is conducted by the printing apparatus. Further, the present invention is directed to a method for correctly performing printing without sustaining the impacts of the inappropriate region, even when using the sheet including the inappropriate region that is inappropriate for printing.

According to an aspect of the present invention, a printing method includes:

a first step for printing a plurality of images in order on a sheet fed from a sheet feeding unit;

a second step for reading the image printed by the first step;

a third step for detecting a region that is inappropriate for printing the fed sheet;

a fourth step for, when the third step has detected the inappropriate region, stopping printing of the image and cutting the sheet, and sending back the sheet at an upstream side of the cut sheets to the sheet feeding unit; and a fifth step for, after the fourth step, feeding the sheet again to perform the first step and the second step.

According to another aspect of the present invention, a check of the printing apparatus can be correctly conducted without being affected by an inappropriate region, even when the sheet including the region that is inappropriate for printing is used.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

An exemplary embodiment of a printing apparatus of an inkjet method will be described below. The printing apparatus according to the present exemplary embodiment uses a long, continuous sheet (long, continuous sheet longer than a print unit (which is referred to as one page or a unit image) that is repeated in a conveyance direction), and is a high-speed line printer capable of both simplex printing and duplex printing. For example, the printing apparatus of the present exemplary embodiment is appropriate for printing a great number of copies in photo printing. In this specification, even if a plurality of small images, letters, or blanks, or combination thereof are included in a region of one print unit (one page), objects included in the region are collectively referred to as one unit image. More specifically, the unit image means one print unit (one page) when a plurality of pages are printed in order on the continuous sheet.

Instead of the "unit image", simply an "image" may be used in some cases. Depending on a size of an image to be printed, a length of the unit image varies. For example, a photo in an "L" size has a length of 135 mm in a sheet conveyance direction and an "A4" size photo has the length of 297 mm. The present invention can be widely applied to printing apparatuses that needs a drying process because of ink use, such as a printer, a printer complex machine, a copy machine, a facsimile apparatus, and production apparatus of various kinds of devices.

Figure 1:
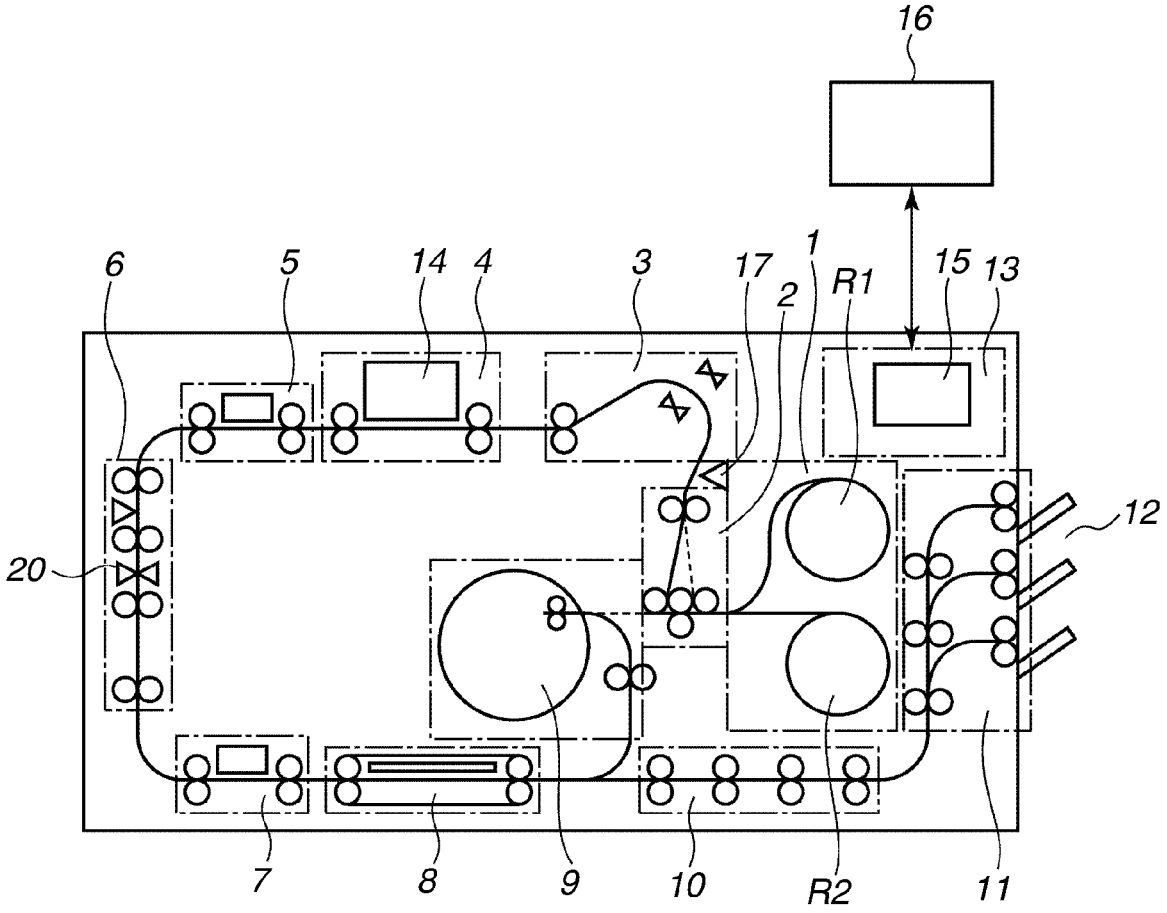
FIG. 1 is a schematic view illustrating an internal configuration of a printing apparatus.

FIG. 1 is a schematic view illustrating an internal configuration of a printing apparatus. The printing apparatus according to the present exemplary embodiment can perform duplex printing on a first surface of the sheet and a second surface that is a rear side of the first face using the sheet rolled in a roll shape. The printing apparatus includes a sheet feeding unit 1, a decurling unit 2, a skew conveyance correction unit 3, a print unit 4, a cutter unit 6, an information recording unit 7, a drying unit 8, a reverse unit 9, a discharge conveyance unit 10, a sorter unit 11, a discharge unit 12, and a control unit 13.

The discharge unit 12 includes the sorter unit 11 and performs discharge processing. The sheet is conveyed by a conveyance mechanism including pairs of rollers and belts along the sheet conveyance pathway indicated by solid lines in FIG. 1, and then processed by each unit. At an arbitrary position of the sheet conveyance pathway from feeding the sheet to discharging it, a side closer to the sheet feeding unit 1 is referred to as an "upstream" side and an opposite side is referred to as a "downstream" side.

The sheet feeding unit 1 retains and feeds the continuous sheet rolled in a roll shape. The sheet feeding unit 1 can store two rolls of R1 and R2, and alternatively draws and feeds the sheet. The rolls that can be stored are not limited to two but may be one or three or more. Further, the sheet is not limited to a roll shape type but may be the continuous sheet. For example, the continuous sheet having perforations by each unit length may be folded back at each perforation and stored in the sheet feeding unit 1.

The decurling unit 2 reduces curling (warpage) of the sheet fed from the sheet feeding unit 1. The decurling unit 2 passes through the sheet being bent to give the sheet the curling in a direction opposite to the curling of the sheet, so that a decurling force operates to reduce the curling.

A skew conveyance correction unit 3 corrects a skew conveyance (tilt from an original conveyance direction) of the sheet which has passed through the decurling unit 2. By pressing an end portion of the sheet at a reference side toward a guide member, the skew conveyance of the sheet can be corrected.

The print unit 4 is a sheet processing unit that performs print processing on the sheet being conveyed by the sheet feeding unit 1 from above to form an image. More specifically, the print unit 4 is a processing unit that performs predetermined processing on the sheet. The print unit 4 includes a plurality of conveyance rollers for conveying the sheet. The print head 14 includes a print head of a line type formed of nozzle arrays of the inkjet method in a range that can cover the maximum width of the sheet to be used.

The print head 14 includes a plurality of print heads that are arranged in parallel in the conveyance direction. According to the present exemplary embodiment, seven print heads are included that correspond to seven colors, i.e., cyan (C), magenta (M), yellow (Y), light cyan (LC), light magenta (LM), gray (G), and black (K). The numbers of the colors and the print heads are not limited to seven.

As the inkjet method, methods can be adopted which use a heating elements, a piezo element, an electrostatic element, and a micro electromechanical system (MEMS). The ink of each color is supplied from each ink tank to the print head 14 via each ink tube.

The test unit 5 optically reads a test pattern or image printed on the sheet by a scanner of the print unit 4, and determines whether the image is correctly printed by checking a state of the nozzles of the print heads, a sheet conveyance state, and image positions. The scanner includes a charge coupled device (CCD) image sensor or a complementary metal oxide semiconductor (CMOS) image sensor.

The cutter unit 6 includes a mechanical cutter 20 that cuts the printed sheet into a predetermined length. The cutter unit 6 further includes a plurality of conveyance rollers for sending to a next step the sheet and a cut mark sensor that optically detects a cut mark recorded on the sheet.

The information recording unit 7 records print information (unique information) including serial numbers and dates of prints in a non-print region of the cut sheet. The recording is performed by printing letters and codes in the inkjet method or a thermal transfer method.

The drying unit 8 heats the sheet printed by the print unit 4 to dry applied ink in a short time. In the drying unit 8, heated air is applied onto the passing sheet from at least a bottom surface side to dry an ink-applied surface. The drying method is not limited to applying the heated air, but irradiating a sheet surface with electro-magnetic waves (ultraviolet rays or infrared rays) is also feasible.

The sheet conveyance pathways from the sheet feeding unit 1 to the drying unit 8 described above is referred to as a first pathway. The first pathway has a shape turning around between the print unit 4 and the drying unit 8, and the cutter unit 6 is located in the middle of the turning-around shape.

When duplex printing is performed, the reverse unit 9 temporarily rolls up the continuous sheet on which front-surface printing has been finished, and reverses a front and a rear of the sheet. The reverse unit 9 is provided in the middle of a pathway (loop path) (which is referred to as a second pathway) leading from the drying unit 8 to the print unit 4 via the decurling unit 2 to feed the sheet that has passed through the drying unit 8 to the print unit 4 again. The reverse unit 9 includes a rotation member (drum) that rotates to roll up the sheet.

The continuous sheet on which the front surface-printing has been finished and has not been cut yet is temporarily rolled up by the rotation member for rolling. When the rolling has been finished, the rolling rotation member reversely rotates, and then the rolled sheet is sent out in a reverse order of the rolling-up, to be fed to the decurling unit 2 and sent to the print unit 4. Since the front and the rear of the sheet are reversed, the print unit 4 can perform printing on the rear surface. When the sheet feeding unit 1 is defined as a first sheet feeding unit, the reverse unit 9 can be considered as a second sheet feeding unit. More specific operations for the duplex printing will be described below.

The discharge conveyance unit 10 conveys the sheet cut by the cutter unit 6 and dried by the drying unit 8, and sends the sheet to the sorter unit 11. The discharge conveyance unit 10 is provided at a pathway (referred to as a "third pathway") which is different from the second pathway where the reverse unit 9 is provided. In order to selectively lead the conveyed sheet to either one of the second and third pathways, a pathway switching mechanism including a movable flapper is provided at a separation position (which is referred to as a "discharge separation position") of the pathway.

The discharge unit 12 including the sorter unit 11 is provided at a side portion of the sheet feeding unit 1 and a tail end of the third pathway. The sorter unit 11 sorts the printed sheets into groups as necessary. The sorted sheets are discharged to a plurality of trays included in the discharge unit 12. As described above, the printing apparatus has a layout in which the third pathway passes below the sheet feeding unit 1 to discharge the sheet to an opposite side of the print unit 4 and drying unit 8 across the sheet feeding unit 1.

As described above, the units from the sheet feeding unit 1 to the drying unit 8 are provided in order along the first pathway. A pathway from the drying unit 8 is divided into the second and third pathways. The second pathway is provided with the reverse unit 9 in the middle, and a pathway from the reverse unit 9 joins the first pathway. The tail end of the third pathway is provided with the discharge unit 12.

Between the decurling unit 2 and the skew conveyance correction unit 3, the surface sensor 17 (detection unit) is provided. The surface sensor 17 optically detects a region of the sheet that is inappropriate for printing the image. At the upstream side of the print unit 4, the surface sensor 17 optically detects the inappropriate region of the sheet fed from the sheet feeding unit (sheet feeding unit 1 or reverse unit 9) from a surface on which printing is performed.

A typical inappropriate region is the splice that is a joint portion of the sheets described above. The continuous sheet to be used may include the splices (joint portions) that connect the continuous sheet using the tape or adhesive at one or more random positions. The surface sensor 17 is, for example, a photo sensor of a reflection type, and grasps a difference of surface reflection ratios between the sheet and the splice (tape) or a gap edge of the tape of the splice from changes of an amount of received reflection light. As the surface sensor 17, a photo sensor of a transmission type may be used, that can detect the splice by grasping the difference of the transmittance between the sheet and the splice.

In addition to the splice, there are inappropriate regions that are inappropriate for printing the image. For example, flaws, folding, breakage, large dust, stains (water-based, oil-based) may be partially given onto the continuous sheet when the sheet is produced. These defects are not permitted when the image is printed. In this specification, the defects described above are collectively referred to as "contamination on the continuous sheet".

Further, another example of the inappropriate region includes symbols and marks that are intentionally marked in advance on the continuous sheet. If the image is printed on the inappropriate regions described above, print quality is greatly deteriorated and defective goods are generated.

The control unit 13 controls each unit of the entire printing apparatus. The control unit 13 includes a central processing unit (CPU), a storage unit, a controller including various control units, an external interface (I/F), and an operation unit 15 via which an operator performs input/output. Operations of the printing apparatus are controlled based on instructions from the controller or a host device 16 such as a host computer connected to the controller via the external interface.

Figure 2:
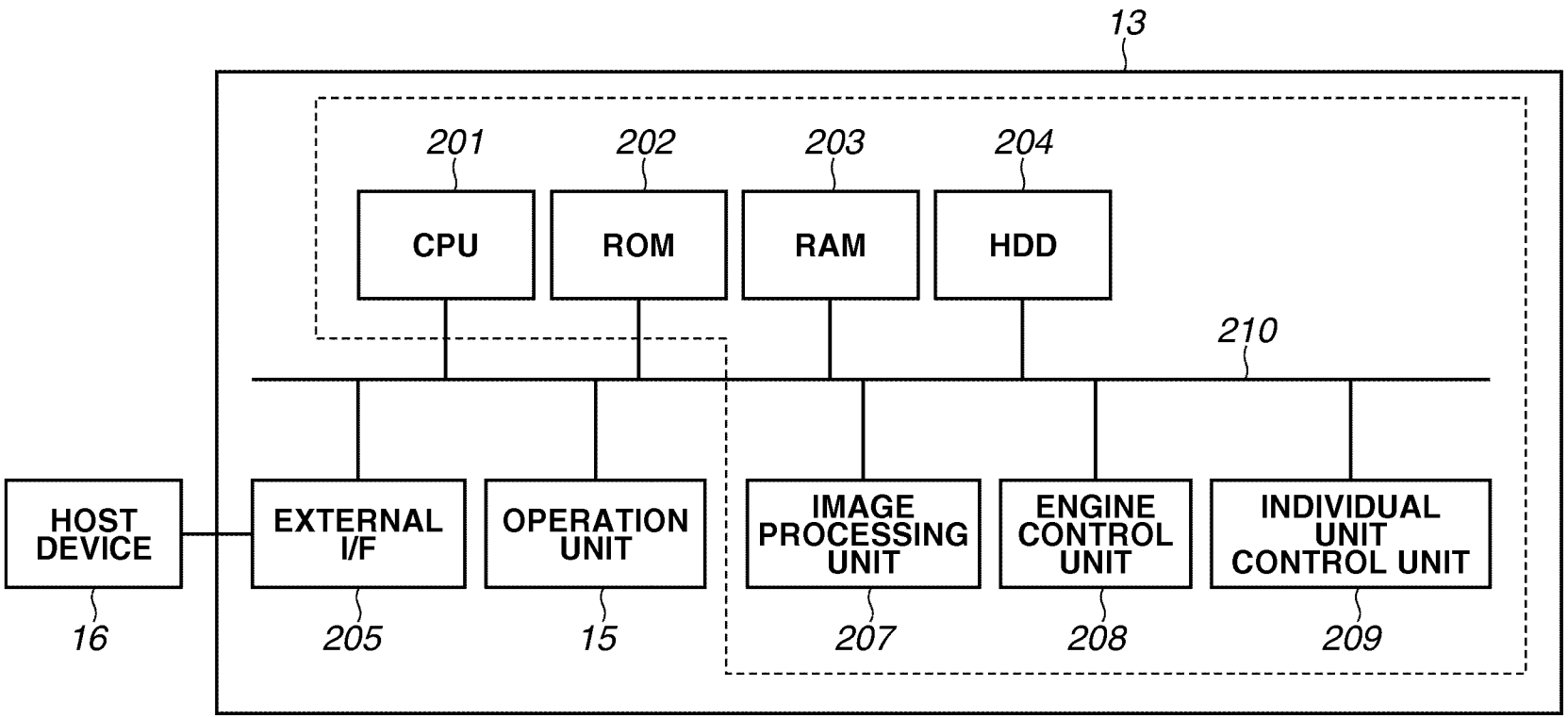
FIG. 2 is a block diagram of a control unit.

FIG. 2 is a block diagram illustrating a concept of the control unit 13. The controller (region surrounded with a broken line) of the control unit 13 includes a CPU, 201, a read only memory (ROM) 202, a random access memory (RAM) 203, a hard disk drive (HDD) 204, an image processing unit 207, an engine control unit 208, and an individual unit control unit 209. The CPU 201 integrally controls the operations of respective units included in the printing apparatus. The ROM 202 stores programs to be executed by the CPU 201 and fixed data necessary for various operations of the printing apparatus.

The RAM 203 is used as a work area of the CPU 201 and a temporary storage region of various reception data, and stores various setting data. The HDD 204 can store and read a program to be executed by the CPU 201, print data, and setting information necessary for various operations of the printing apparatus. An operation unit 15 is an input/output interface with the operator, and includes an input unit such as a hard key and a touch panel, and an output unit such as a display and an audio generator which provide information.

A special processing unit is provided for a unit that requests high speed data processing. The image processing unit 207 performs image processing on print data dealt with by the printing apparatus. The image processing unit 207 converts a color space (e.g., YCbCr) of input image data into a red, green, black (RGB) space (e.g., sRGB). Further, various image processing such as resolution conversion, image analysis, and image correction is performed on the image data as necessary. The print data acquired by such image processing is stored in the RAM 203 or the HDD 204. According to the print data based on a control command received from the CPU 201, the decurling unit 208 performs driving control on the print head 14 of the print unit 4.

An engine control unit 208 further controls a conveyance mechanism of each unit in the printing apparatus. An individual unit control unit 209 is a sub controller that individually controls each unit of the sheet feeding unit 1, the decurling unit 2, the skew conveyance correction unit 3, the test unit 5, the cutter unit 6, the information recording unit 7, the drying unit 8, the reverse unit 9, the discharge conveyance unit 10, the sorter unit 11, and the discharge unit 12. Based on an instruction by the CPU 201, the individual unit control unit 209 controls the operation of each unit. An external interface 205 connects the controller to the host device 16, and is a local I/F or a network I/F. The constituent elements described above are connected to each other via a system bus 210.

The host device 16 is a supply source of the image data for causing the printing apparatus to perform printing. The host device 16 may be a general computer, dedicated computer, or an imaging device exclusively for capturing an image such as an image reader unit, a digital camera, or photo storage. When a computer is used as the host device 16, an office system (OS), application software creating the image data, a printer driver for the printing apparatus are installed in the storage device. All processing described above is not necessarily realized by the software, and apart of or all of the processing may be realized by the hardware.

Next, basic operations at the time of printing will be described below. Since a printing operation varies depending on the simplex printing mode or the duplex mode, each operation will be described below.

In the simplex printing mode, the print unit 4 performs printing on the surface (first surface) of the sheet that is fed from the sheet feeding unit 1 and processed by each of the decurling unit 2 and the skew conveyance correction unit 3. On the long, continuous sheet, the image (unit image) having a predetermined unit length in the conveyance direction is printed in order and a plurality of images are arranged and formed. Herein, a blank region is provided between an image and a subsequent image, and a cut mark is recorded in the blank region by the print unit 4. The printed sheet passes through the test unit 5 and is cut by unit image with the cutter 20 in the cutter unit 6.

The print information is recorded by the information recording unit 7 on the rear surface of the cut sheet that has been cut as necessary. The cut sheets are conveyed one by one to the drying unit 8 and dried. Subsequently, via the discharge conveyance unit 10, the cut sheet is discharged in order to the discharge unit 12 of the sorter unit 11 and stacked therein. On the other hand, the sheet left on a side of the print unit 4 when the sheet is last cut into the unit image is sent back to the sheet feeding unit 1, and the left sheet is rolled up by the roll R1 or R2. As described above, in the simplex printing, the sheet passes through the first and third pathways for processing, and does not pass through the second pathway.

In the duplex printing, following a front surface (first surface) print sequence, a rear surface (second surface) print sequence is performed. First, in the front surface print sequence, the operation of each unit from the sheet feeding unit 1 to the test unit 5 is the same as that in the simplex printing described above. The cutter unit 6 does not perform the cutting operation, and the continuous sheet is conveyed to the drying unit 8 as it is. After the drying unit 8 dries the ink on the surface, the sheet is led not to the pathway (third pathway) on the side of the discharge conveyance unit 10 but to the pathway (second pathway) on the side of the reverse unit 9. In the second pathway, the sheet is rolled up by the rotation member for rolling in the reverse unit 9 rotating in a forward direction (counterclockwise direction in FIG. 1).

When the print unit 4 finishes all printing to be performed on the surface, the cutter unit 6 cuts a rear end of the print region of the continuous sheet. With reference to a cut position, the continuous sheet at the downstream side in the conveyance direction (printed side) passes through the drying unit 8 and is rolled up to the rear end (cut position) of the sheet by the reverse unit 9. On the other hand, simultaneously with the rolling described above, the continuous sheet left behind at the upstream side (print unit 4 side) of the cut position in the conveyance direction is rolled back by the sheet feeding unit 1 and rolled by the roll R1 or R2 so that an end portion (cut position) of the sheet is not left behind at the decurling unit 2. By rolling back (feeding back) the sheet, the sheet can avoid collision with another sheet to be fed again in the rear surface print sequence.

Subsequently, the front surface print sequence described above is switched to the rear surface print sequence. The rotation member for rolling in the reverse unit 9 rotates in a direction (clockwise direction in FIG. 1) opposite to the direction at the time of rolling the sheet. The end portion of the rolled sheet (a trailing edge of the sheet at the time of rolling becomes a leading edge at the time of sending out) is sent into the decurling unit 2 along the pathway illustrated with the broken line in FIG. 1. The decurling unit 2 corrects the curling generated by the rotation member for rolling. More specifically, the decurling unit 2 is provided between the sheet feeding unit 1 and the print unit 4 in the first pathway, and further between the reverse unit 9 and the print unit 4 in the second pathway. The decurling unit 2 is a common unit that performs decurling in both pathways.

The sheet whose front surface and rear surface have been reversed passes through the skew conveyance correction unit 3, and sent to the print unit 4, and then the unit image and the cut mark are printed on the rear surface of the sheet. The printed sheet passes through the test unit 5 and is cut by unit length that is previously set by the cutter unit 6. Since printing is performed on the both surfaces of the cut sheet, the information recording unit 7 does not perform the recording. The cut sheets are conveyed to the drying unit 8 one by one, and, via the discharge conveyance unit 10, discharged in order to the discharge unit 12 of the sorter unit 11 and stacked therein. As described above, in the duplex printing, the sheet passes in order through the first, second, first, and third pathways to undergo the processing.

The operations of the normal print mode have been described above. The printing apparatus according to the present exemplary embodiment further has a maintenance mode. In the maintenance mode, the test images including a specific pattern different from a normal image on the continuous sheet are printed in order, and the pattern is read by the scanner to be analyzed so that a state of the printing apparatus can be checked.

There are various types of maintenances of the printing apparatus, and one of which is color shading correction. The color shading correction prints the test image including several tens of thousands of color patterns for color calibration of a color image, and then reads the test image with the scanner of the test unit to check whether the test image is output in correct colors. When color misregistration occurs, an amount of applied ink in each color is adjusted to correct the color shift. Another example of the maintenance is a discharge trouble test of the print head. The test image printed for the discharge trouble test is read by the scanner to check whether the nozzle has a discharge trouble. When the nozzle has the discharge trouble, the ink is previously discharged from the print head to the sheet to conduct head maintenance.

Processing when the inappropriate region is detected while the test image for the maintenance is being printed in the maintenance mode will be described below. The maintenance mode may be incorporated in the middle of the normal image printing schedule, or the maintenance processing may be performed as a mode independent from the normal image printing.

Figure 3A:
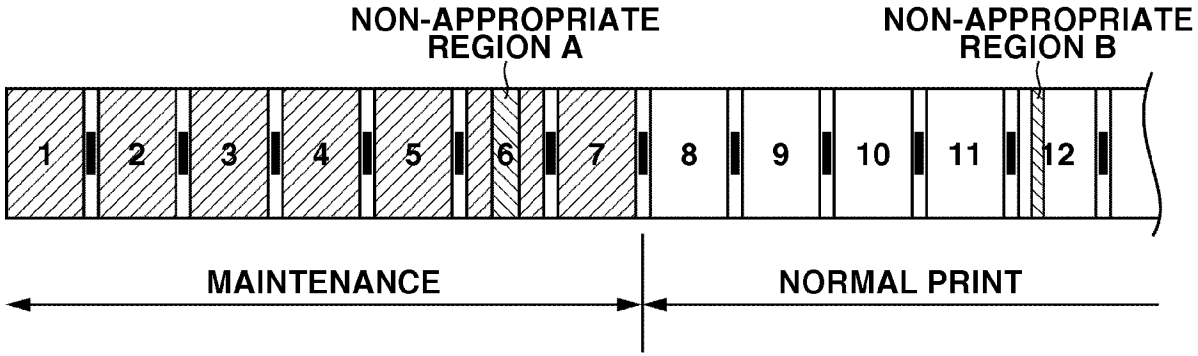
FIGS. 3A and 3B illustrate a concept of printing schedules.
Figure 3B:
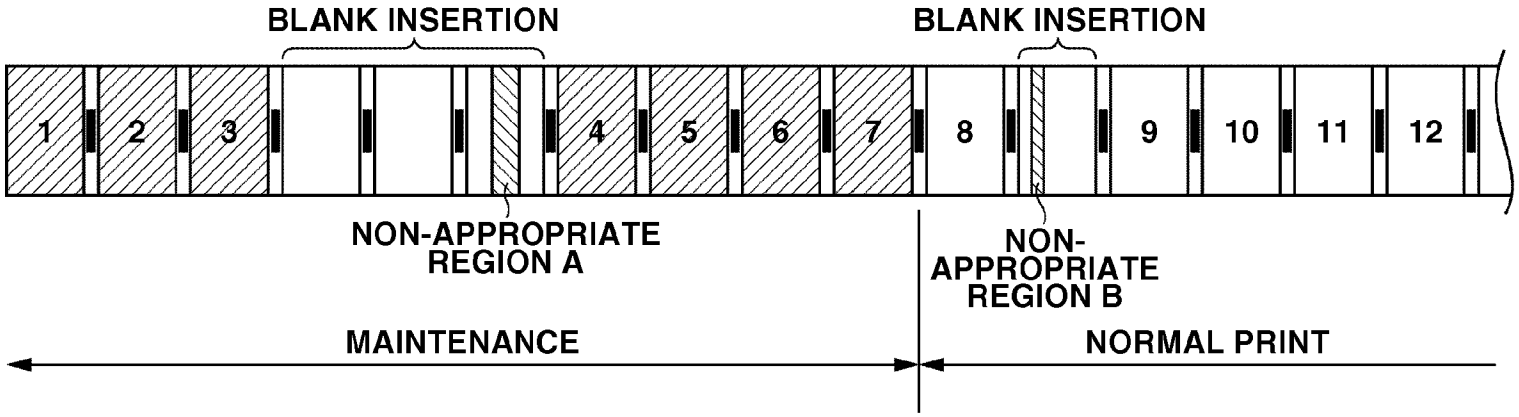

FIGS. 3A and 3B illustrate a concept of the printing schedules in an example where the maintenance mode is incorporated at a beginning of the normal image print. FIG. 3A illustrates an arrangement of the images of the initial printing schedule, and the images are arranged in order from an image 1 on the sheet and printed. In a small blank space between the images, the cut mark indicating a sheet cut position is formed. In this example, images 1 to 7 are the test images for color calibration. A region in which a plurality of test images is continuously printed is referred to as a "maintenance region". Subsequent images from an image 8 are normal images that are finally printed as final print result objects. A region in which the normal images are continuously printed is referred to as a "normal print region".

If the maintenance region includes the inappropriate region, since the printing is not performed correctly on the inappropriate region, a result read by the test unit is different from what it should be, so that the test cannot be correctly conducted. According to the example of FIG. 3A, a region of an image 6 includes the inappropriate region "A". Thus, the test using the test image of the image 6 cannot be correctly conducted.

According to the present exemplary embodiment, the printing schedule is changed so that the test image can be printed avoiding the inappropriate region "A". The printing schedule is information for printing the test images (images 1 to 7) in a predetermined order and with a predetermined interval. In the example of FIG. 3B, since the region in which the image 6 is to be printed includes the inappropriate region "A", in order to avoid the inappropriate region "A", an image 4 and subsequent images thereof are collectively shifted behind the inappropriate region "A". Thus, blank is generated after the images are shifted.

Herein, the region for three images including the inappropriate region "A" becomes a blank portion. This is because relative distances among the images 4, 5, 6 are meaningful and the images include the specific pattern that needs to be treated as a group of images. If the blank is inserted between the images 4 and 5, or between the images 5 and 6, a purpose of the test cannot be realized. Thus, since a group of images 4 to 6 are shifted behind the inappropriate region "A", the blank for three images is inserted.

Similarly, if the normal print region includes the inappropriate region, the normal image is not correctly printed on the inappropriate region. In the example of FIG. 3A, a region of an image 12 includes an inappropriate region "B". In order to avoid the inappropriate region "B", the printing schedule is changed to print the normal image avoiding the inappropriate region "B". According to the example of FIG. 3B, since a region where an image 9 is to be printed includes the inappropriate region "B", in order to avoid the inappropriate region "B", the image 9 and subsequent images thereof are entirely shifted behind the inappropriate region "B". As described above, the blank may not be inserted between the adjacent test images. However, since the normal image is each completed as one image and independent, the blank can be inserted at an arbitrary position.

According to the reset printing schedule illustrated in FIG. 3B, the plurality of images is printed in order by the print head on the sheet fed from the sheet feeding unit 1. As described above, when the inappropriate region has been detected in the maintenance region, depending on a type of the test image, it is set whether to separately print the first and second images included in the plurality of test images before and behind the inappropriate region, or to continuously print the first and second images behind the inappropriate region. With this setting, even if the sheet includes the inappropriate region at an arbitrary position, since the same sheet is used to continue the test, the state of the print head can be correctly checked.

Further, a method other than the method described above can be also adopted. For example, when the inappropriate region is detected in the maintenance region, printing the test image is stopped, the sheet is cut. Then the sheet at the downstream side of the cut sheets is discharged while the sheet at the upstream side is sent back to the sheet feeding unit. Subsequently the sheet is fed from the sheet feeding unit again to conduct the test again. With this setting, even if the inappropriate region is located at any position on the sheet, since another sheet is used to continue the test, the state of the print head can be correctly checked.

Figure 4:
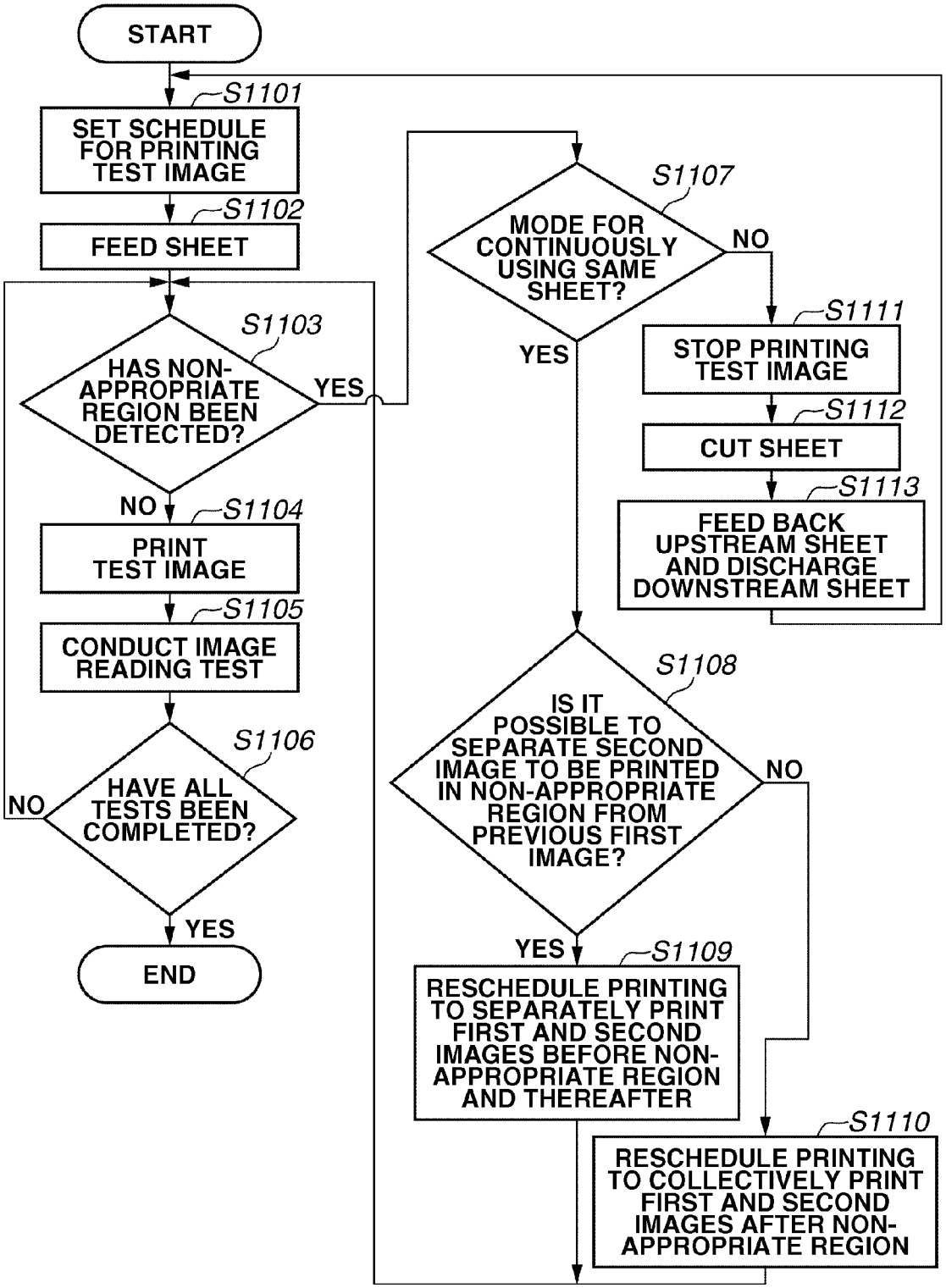
FIG. 4 is a flowchart illustrating a processing sequence when inappropriate regions are detected during head maintenance printing.

With reference to a flowchart illustrated in FIG. 4, a specific processing sequence in the maintenance mode will be described. The sequence described below is performed in the maintenance mode in which the test images of the images 1 to 7 are printed.

In step S1101, the initial printing schedule is generated on the memory. In step S1102, the sheet is fed from the sheet feeding unit 1 to the print unit 4. In step S1103, it is determined whether the surface sensor 17 has detected the inappropriate region of the sheet during printing (YES) or not (NO). Since the surface sensor 17 is located at the upstream side of the print position of the print unit 4 along the conveyance pathway, it can be previously known before printing whether the region in which the printing is to be performed subsequent to the image currently being printed, includes the inappropriate region. When the determination is YES in step S1103, the processing proceeds to step S1107. When the determination is NO in step S1103, the processing proceeds to step S1104.

In step S1103, when the inappropriate region of the fed sheet passes through the detection position (right below the surface sensor 17), a signal level of the surface sensor 17 changes, and it is detected that the inappropriate region has passed.

In step S1104, according to the generated printing schedule, the test images and maintenance patterns are sequentially printed on the fed sheet in a predetermined order. In step S1105, the test unit 5 reads the printed test image and analyzes the image data to check the state of the print head.

In step S1106, it is determined whether printing of the test images according to the printing schedule and the tests have been all finished (YES) or not (NO). When the determination is YES in step S1106, the sequence ends. When the determination is NO in step S1106, the processing returns to step S1103 to repeat the processing.

On the other hand, in step S1107, it is determined whether the printing apparatus is set to a mode for continuously using the same sheet for printing the test images (YES) or not (NO). The mode for continuously using the same sheet to print the test images is referred to as a first mode, another mode is referred to as a second mode. When the determination is YES in step S1107, the processing proceeds to step S1108 to process the first mode. When the determination is NO in step S1107, the processing proceeds to step S1111 to process the second mode.

In the first mode, in step S1108, it is determined whether the test can be conducted even when the position of the test image (referred to as the second image) to be originally printed at the position where the inappropriate region is located, is shifted and printed to avoid the inappropriate region. For example, when the relative distance between the pattern included in the test image (referred to as the first image) to be formed primarily preceding the second image, and the pattern included in the second pattern is meaningful, if the blank is inserted between the first and second images to widen the distance, the purpose of the test cannot be realized.

As described above, in step S1108, it is determined whether a positional relationship of the second image with the first image can be changed to separate the first and second images (YES) or not (NO). When the determination is YES in step S1108, the processing proceeds to step S1109. When the determination is NO in step S1108, the processing proceeds to step S1110.

In step S1109, the printing schedule is rescheduled so that the test images (first and second images) are separated into before and behind the inappropriate region with a more interval than the original interval to avoid the inappropriate region, and then printed. Setting the printing schedule again is referred to as reschedule. The reschedule sets the schedule again so that the arranged test images including the second image and the subsequent images are shifted behind the inappropriate region and printed avoiding the region. The existing printing schedule is not changed up to the first image. After step S1109, the processing returns to step S1103 to repeat the processing.

In step S1110, the reschedule is carried out such that, in order to avoid the inappropriate region, behind the inappropriate region (on an upstream side), the plurality of test images (first and second images) that cannot be separated are continuously printed. More specifically, the reschedule is carried out such that, behind the inappropriate region, the first and second images are collectively printed. If all the test images cannot be separated from one another, even if some test images are already printed, all test images are newly printed behind the inappropriate region. After step S1110, the processing returns to step S1103 to repeat the processing.

As described above, in the first mode, when the inappropriate region has been detected, depending on the type of the test image, it is set whether to separately print the first and second images included in the plurality of test images before and behind the inappropriate region, or to continuously print the first and second images behind the inappropriate region. In the first mode, since, even if the inappropriate region is located at any position of the sheet, the same sheet is used to continue the test, the state of the print head can be correctly checked.

In step 1107, when it is determined that the second mode is set for the printing apparatus, processing is performed in the second mode. In the second mode, the sheet that has been already used is discarded and all test images are printed again on a new sheet to conduct the test.

In the second mode, in step S1111, a print operation on the current test images is stopped, and then the existing printing schedule is once cleared.

In step S1112, the sheet is sent up to a predetermined position, and then cut by the cutter unit 6. The predetermined position refers to a position of the cutter of the cutter unit 6 behind (on an upstream side) the test image that has been last printed. In step S1113, the sheet at the downstream side that is cut and separated into two is discharged from the print unit and the sheet at the upstream side is sent back to the sheet feeding unit 1. When the sheet is cut after the printing has been completed, the sheet at the upstream side is sent back to the sheet feeding unit 1. At this point, a part of the sheet instead of all the sheet may be sent back and another part of the sheet may be left behind for the next processing. In this case, time for feeding the sheet in step S1102 in the next processing can be reduced.

Further, in step S1112, the cut position may be set such that the sheet is cut at the downstream side of the inappropriate region. In this case, when the sheet sent back to the sheet feeding unit 1 in step S1113 is used again, the inappropriate region appears at a position a certain distance away from a leading edge of the sheet. Therefore, in step S1102 in the next processing, the sheet is sent without printing until the inappropriate region passes through the print position, and then the test images are started to be printed. Thus, the test can be conducted without being affected by the inappropriate region. After the step S1113, the processing returns to S1101 to perform the same processing. In this case, the test image is newly printed again on a new sheet.

As described above, in the second mode, if the inappropriate region is detected, printing of the test image is stopped and the sheet is cut. Of the cut sheets, the sheet at the downstream side is discharged, and the sheet at the upstream side is sent back to the sheet feeding unit. Then, the sheet is fed again from the sheet feeding unit to conduct the test again. In the second mode, even if the inappropriate region is located at any position of the sheet, since another sheet is used to continue the test, the state of the print head can be correctly checked.

As described above, according to the present exemplary embodiment, since, if the inappropriate region is detected while the test image is being printed, the test is continued avoiding the inappropriate region, the test can be correctly conducted without being affected by the inappropriate region.

Another exemplary embodiment will be described. According to the exemplary embodiment, prior to the test, it is previously checked whether the sheet having the length to be used does not include the inappropriate region. With this check performed, detection of the inappropriate region is not necessary during the test.

Figure 5:
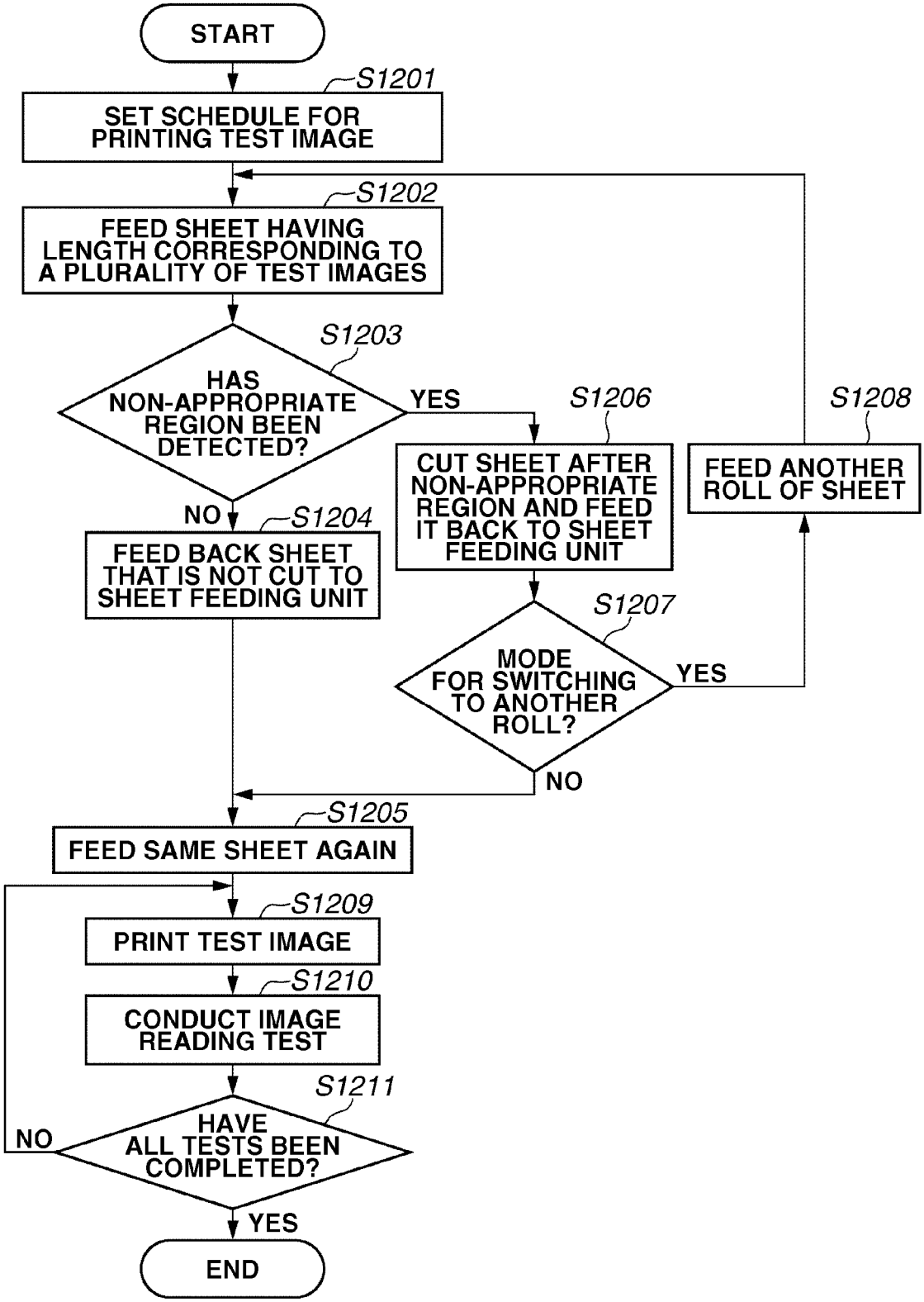
FIG. 5 is a flowchart illustrating a processing sequence of another exemplary embodiment.

FIG. 5 is a flowchart illustrating a sequence of the processing describe above. In step S1201, an initial printing schedule is generated on a memory. In step S1202, the sheet feeding unit 1 feeds the sheet having a predetermined length necessary to print, at least, the test images included in the printing schedule.

In step S1203, it is determined whether the surface sensor 17 detects the inappropriate region of the fed sheet (YES) or not (NO). When the determination is YES in step S1203, the processing proceeds to step S1206. When the determination is NO in step S1203, the processing proceeds to step S1204.

In step S1204, the sheet checked over the predetermined length in step S1203 is sent back to the sheet feeding unit 1 as it is without cutting.

In step S1205, the sheet in the same roll as the sent back sheet is fed again from the sheet feeding unit 1 to the print unit 4. In step S1204, when the sheet is cut after the printing has been completed, the sheet at the upstream side is sent back to the sheet feeding unit 1. At this point, a part of the sheet instead of all the sheet may be sent back and another part of the sheet may be left behind for the next processing. In this case, time for feeding the sheet in step S1205 in the next processing can be reduced.

In step S1209, according to the printing schedule, the test images and maintenance patterns are sequentially printed on the fed sheet in the predetermined order. In step S1210, the test unit 5 reads the printed test image and analyzes the image data to check the state of the print head.

In step S1211, it is determined whether printing of the test images according to the printing schedule and the tests have been all finished (YES) or not (NO). When the determination is YES in step S1211, the sequence ends. When the determination is NO in step S1211, the processing returns to step S1209 to repeat the processing.

On the other hand, when the inappropriate region is detected by the determination process in step S1203, the processing proceeds to step S1206 to perform processing for excluding the inappropriate region. In step S1206, the sheet is sent up to the predetermined position, and cut by the cutter unit 6. The inappropriate region of the sheet is sent UP to the position of the cutter of the cutter unit 6. The cut sheet at the downstream side that is separated into two is discharged from the print unit and the sheet at the upstream side is sent back to the sheet feeding unit 1.

In step S1207, it is determined whether, if the inappropriate region is detected, the printing apparatus is set to switch the mode to another roll (YES) or (NO). When the determination is YES in step S1207, the processing proceeds to step S1208. When the determination is NO in step S1207, the processing proceeds to step S1205.

In step S1206, when the sheet is cut after the printing has been performed last, the sheet at the upstream side is sent back to the sheet feeding unit 1. At this point, a part of the sheet instead of all the sheet may be sent back and another part of the sheet may be left behind for the next processing. In this case, time for feeding the sheet in step S1205 in the next processing can be reduced.

In step S1208, a new sheet is fed from another roll. For example, when the roll R1 is in use, then the sheet of the roll R2 is fed. After step S1208, the processing returns to step S1202 to repeat the same processing.

As described above, since it is previously confirmed that the sheet in the range used for the test includes no inappropriate region, when the test image print and the image reading test are repeated, the detection of the inappropriate region is not performed. Since the inappropriate region does not appear during the test, it is advantageous that the unnecessary consumption of the sheet can be reduced.

The processing for printing the test image in the maintenance mode when the inappropriate region is detected, has been mainly described. The present invention is not limited thereto, but the same processing can also be applied when the inappropriate region is detected when the normal image is printed (normal printing illustrated in FIG. 3).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-025253 filed Feb. 8, 2011, which is hereby incorporated by reference herein in its entirety.

What is claimed is:

1. A printing method comprising:

feeding a continuous sheet with a sheet feeding unit;

printing with a printing unit a plurality of images on the continuous sheet fed from the sheet feeding unit;

detecting with a detection unit positioned upstream of the printing unit an inappropriate region that is part of the continuous sheet and is inappropriate for printing;

after detecting the inappropriate region, stopping the printing of the plurality of images, cutting the continuous sheet at a position upstream of the inappropriate region to produce a cut sheet and a cut continuous sheet, feeding the cut continuous sheet backward with the sheet feeding unit, and discharging the cut sheet; and after the cut sheet is discharged, feeding the cut continuous sheet with the sheet feeding unit, printing the plurality of images on the cut continuous sheet fed from the sheet feeding unit, and detecting with the detection unit another inappropriate region on the cut continuous sheet that is inappropriate for printing.

2. The printing method according to claim 1, wherein the inappropriate region includes splice of the continuous sheet, a contaminated portion, or a portion that has been previously marked thereon.

3. A printing method comprising:

feeding a continuous sheet with a sheet feeding unit;

printing with a printing unit a plurality of images on the continuous sheet fed from a sheet feeding unit;

detecting with a detection unit positioned upstream of the printing unit an inappropriate region that is part of the continuous sheet and is inappropriate for printing;

after detecting the inappropriate region, stopping the printing of the plurality of images, cutting the continuous sheet at a position downstream of the inappropriate region to produce a cut sheet and a cut continuous sheet, feeding the cut continuous sheet backward with the sheet feeding unit, and discharging the cut sheet; and after the cut sheet is discharged, feeding the cut continuous sheet with the sheet feeding unit so that the inappropriate region passes the printing unit without being printed, printing the plurality of images on the cut continuous sheet fed from the sheet feeding unit after the inappropriate region on the cut continuous sheet has passed the printing unit, and detecting with the detection unit another inappropriate region on the cut continuous sheet that is inappropriate for printing.

4. A printing apparatus comprising:

a sheet feeding unit configured to feed a continuous sheet;

a printing unit configured to print a plurality of images in order on the continuous sheet fed by the sheet feeding unit;

a detection unit positioned upstream of the printing unit configured to detect an inappropriate region that is part of the continuous sheet and is inappropriate for printing; and a control unit configured, after the detection unit detects the inappropriate region, to control the printing unit to stop printing the plurality of images, to control a cutting unit to cut the continuous sheet at an upstream position of the inappropriate region to produce a cut sheet and a cut continuous sheet, and to control the sheet feeding unit to send back the cut continuous sheet and to discharge the cut sheet, and the control unit is further configured, after the cut sheet is discharged, to control the sheet feeding unit to feed the cut continuous sheet, to control the printing unit to print the plurality of images on the cut continuous sheet fed from the sheet feeding unit, and to control the detecting unit to detect another inappropriate region on the cut continuous sheet that is inappropriate for printing.

5. A printing apparatus comprising:

a sheet feeding unit configured to feed a continuous sheet;

a printing unit configured to print a plurality of images in order on the continuous sheet fed by the sheet feeding unit;

a detection unit positioned upstream of the printing unit configured to detect an inappropriate region that is part of the sheet and is inappropriate for printing; and a control unit configured, after the detection unit detects the inappropriate region, to control the printing unit to stop printing the plurality of images, to control a cutting unit to cut the continuous sheet at a downstream position of the inappropriate region to produce a cut sheet and a cut continuous sheet, to control the sheet feeding unit to send back the cut continuous sheet to the sheet feeding unit and to discharge the cut sheet, and the control unit is further configured, after the cut sheet is discharged, to control the sheet feeding unit to feed the cut continuous sheet so that the inappropriate region passes the printing unit without being printed, to control the printing unit to print the plurality of images on the cut continuous sheet after the inappropriate region on the cut continuous sheet has passed the printing unit, and to control the detection unit to detect another inappropriate region on cut continuous sheet that is inappropriate for printing.

* * * * *